US007922542B1

(12) United States Patent
Shu et al.

(10) Patent No.: US 7,922,542 B1
(45) Date of Patent: Apr. 12, 2011

(54) AUDIO JACK CONNECTOR

(75) Inventors: Ke-Qi Shu, Guang-Dong (CN); Kai-Hsiang Chang, Tu-Cheng (CN); Kuo-Chin Lin, Tu-Cheng (CN)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/757,196

(22) Filed: Apr. 9, 2010

(51) Int. Cl.
*H01R 24/04* (2006.01)

(52) U.S. Cl. ..... 439/668; 439/188; 439/490

(58) Field of Classification Search ..... 439/668, 439/669, 490, 188
See application file for complete search history.

(56) References Cited

U.S. PATENT DOCUMENTS 7,753,738 B2 * 7/2010 Zhang ..... 439/668
7,785,119 B1 * 8/2010 Chiang ..... 439/188
2002/0052148 A1 * 5/2002 Nagata ..... 439/668
2005/0048847 A1 * 3/2005 Hsieh ..... 439/668
2007/0232150 A1 * 10/2007 Lee ..... 439/668

* cited by examiner

*Primary Examiner* — Hien Vu
(74) *Attorney, Agent, or Firm* — Cheng-Ju Chiang

(57) ABSTRACT

An audio jack connector includes a dielectric housing, a signal terminal and a detection terminal. The dielectric housing defines a receiving trough at a top surface thereof. An opening is defined in the receiving trough with a notch communicated with a rear end thereof. A location slot is defined at a side of the dielectric housing to intersect the notch. The detection terminal is received in the location slot and has an inclined portion inclined towards the notch. The inclined portion has a protuberance provided on an outer surface thereof. The signal terminal is received in the receiving trough and has a concaved portion projected into the insertion hole from the opening and a cantilever arm located to the notch. A free end of the cantilever arm is inclined downward to form a pressing portion for pressing against the protuberance of the detection terminal.

6 Claims, 5 Drawing Sheets

AUDIO JACK CONNECTOR

BACKGROUND OF THE INVENTION

1. Field of the Invention

The present invention relates to an audio jack connector, and more particularly to an audio jack connector capable of currently detecting whether an audio plug is inserted or not.

2. The Related Art

Audio jack connectors are widely used in kinds of electronic equipments, such as MP3/MP4, mobile phones, computers and other equipments for transmitting sound signals. A conventional audio jack connector includes an insulating housing and a switch terminal assembly received in the insulating housing. The switch terminal assembly includes a fixed terminal and a movable terminal. The movable terminal has a flat first contact portion. The fixed terminal has a flat second contact portion pressed under the first contact portion of the movable terminal. When an audio plug is inserted into the audio jack connector, the first contact portion of the movable terminal will be pushed away by the audio plug to disconnect with the second contact portion of the fixed terminal. When the audio plug is drawn out from the audio jack connector, the first contact portion of the movable terminal restores to press against and electrically connect with the second contact portion of the fixed terminal again.

However, because the first contact portion and the second contact portion are flat, the contact between the first contact portion and the second contact portion may be unstable or even disconnection if they are oxidized or stuck with external objects (e.g., dust or greasiness) on the surfaces thereof. Thereby, the switch terminal assembly will not currently detect whether the audio plug is inserted or not.

SUMMARY OF THE INVENTION

It is an object of the present invention to provide an audio jack connector capable of currently detecting whether an audio plug is inserted or not. The audio jack connector adapted for receiving an audio plug includes a dielectric housing, a signal terminal and a detection terminal received in the dielectric housing. The dielectric housing defines an insertion hole extended along a front and rear direction for receiving the audio plug from a front thereof and a receiving trough at a rear portion of a top surface thereof. An opening is defined at a middle of the receiving trough. A notch is communicated with a rear end of the opening and transversely penetrating through a side of the dielectric housing. A location slot is defined at the side of the dielectric housing to intersect the notch. The detection terminal has a fixed base inserted into the location slot and an inclined portion inclined towards the notch from a top of the fixed base. The inclined portion has a protuberance provided on an outer surface thereof. The signal terminal is received in the receiving trough, having a base plate and an elastic arm extended rearward from a middle of a rear edge of the base plate. The elastic arm has a concaved portion formed at a rear end thereof to project into the insertion hole from the opening and a cantilever arm transversely connected to a rear of the concaved portion by an inner end thereof to be located to the notch. A free end of the cantilever arm is inclined downward to form a pressing portion for pressing against or detaching from the protuberance of the detection terminal when the audio plug is drawn out or inserted into the insertion hole of the dielectric housing.

As described above, because of the inclination arrangement of the pressing portion and the inclined portion, during pressing down the protuberance, the pressing portion rubs against protuberance at the same time to remove the external objects formed therebetween. And therefore, the electrical connection between the pressing portion and the protuberance is stable, which helps to currently detect whether the audio plug is inserted or not.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
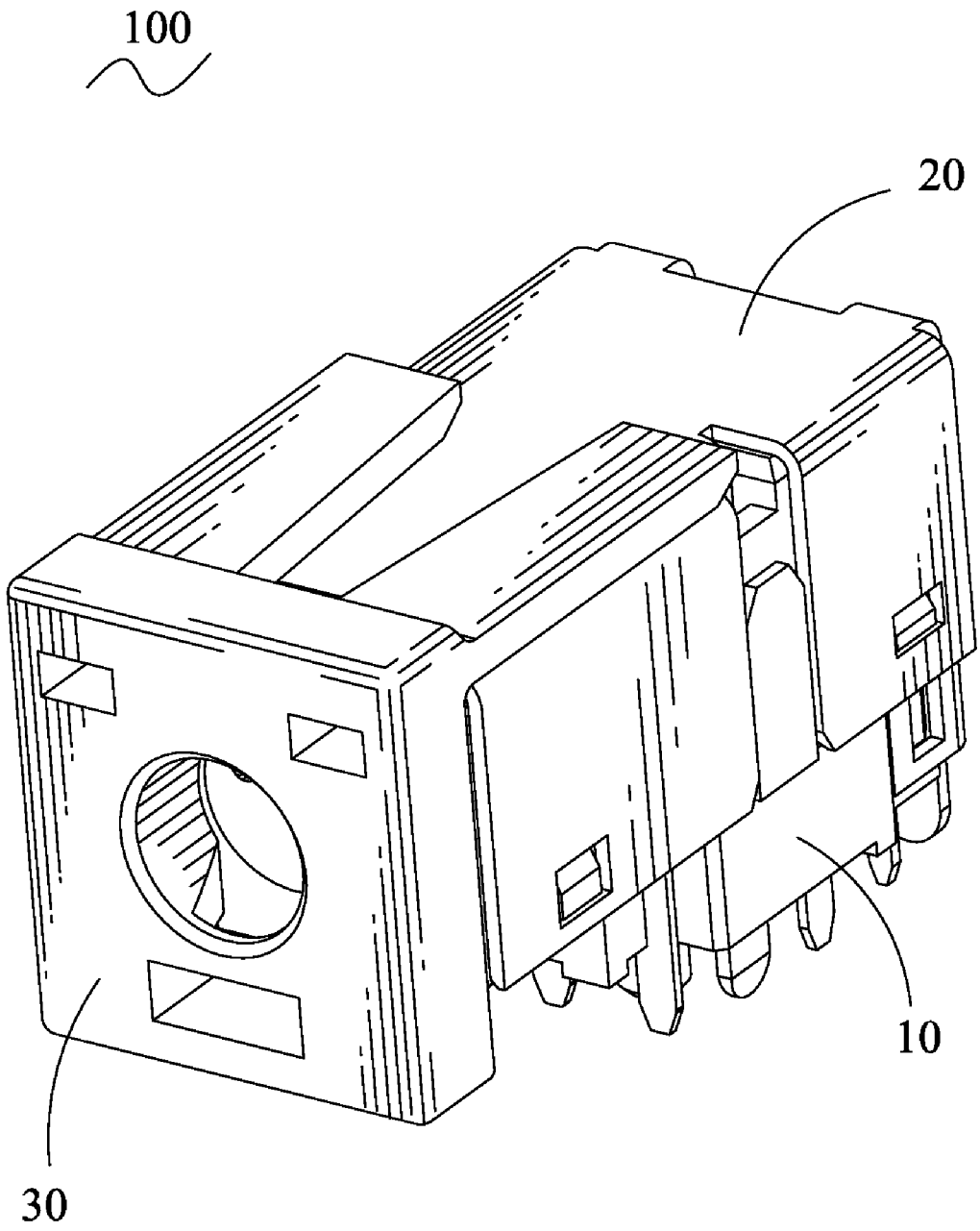
FIG. 1 is a perspective view of an audio jack connector in accordance with the present invention.
Figure 2:
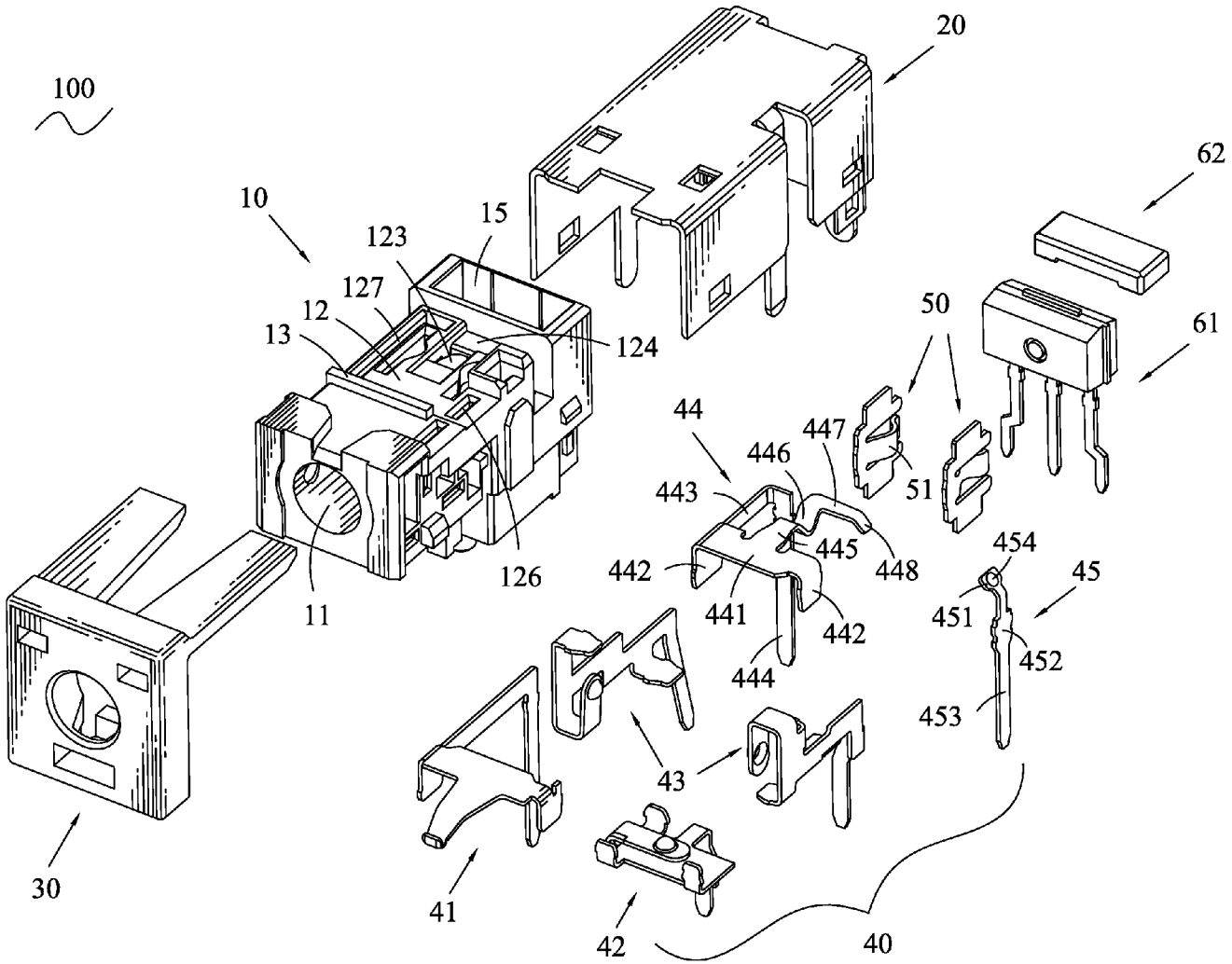
FIG. 2 is an exploded view of the audio jack connector shown in the FIG. 1.

With reference to FIGS. 1 and 2, an audio jack connector 100 according to the present invention is shown. The audio jack connector 100 includes a dielectric housing 10, a shielding shell 20, an insulating cap 30, a plurality of terminals 40, a pair of retention pieces 50, an LED 61 and an LED cover 62. The terminals 40 include a microphone terminal 41, a first signal terminal 42, two grounding terminals 43, a second signal terminal 44 and a detection terminal 45.

Figure 3:
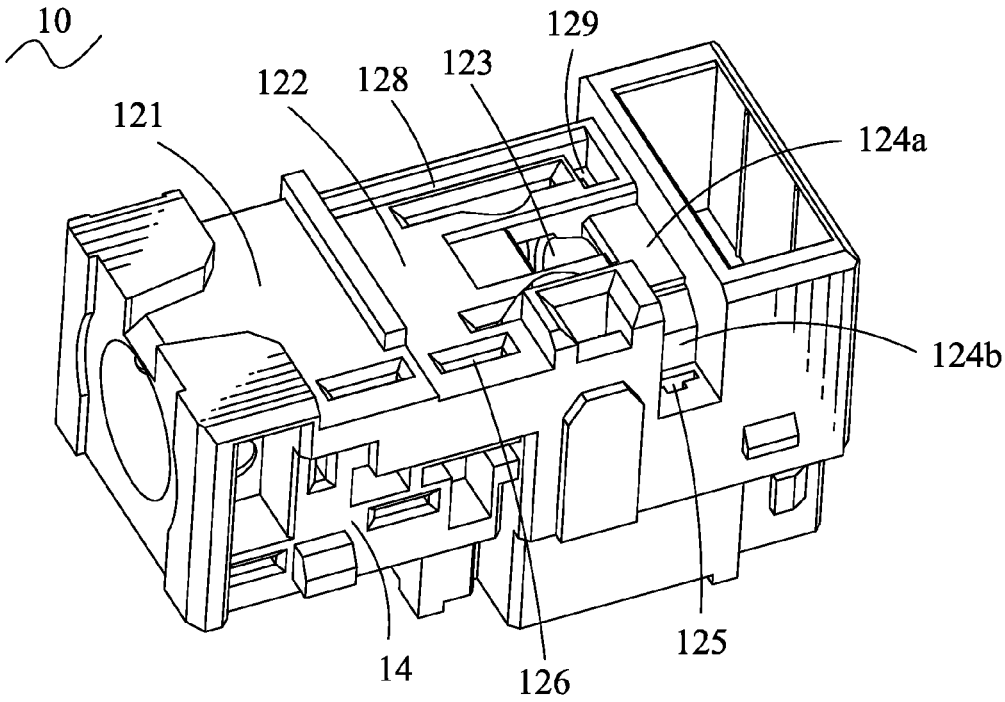
FIG. 3 and FIG. 4 are perspective views of dielectric housing of the audio jack connector showing at different angles.
Figure 4:
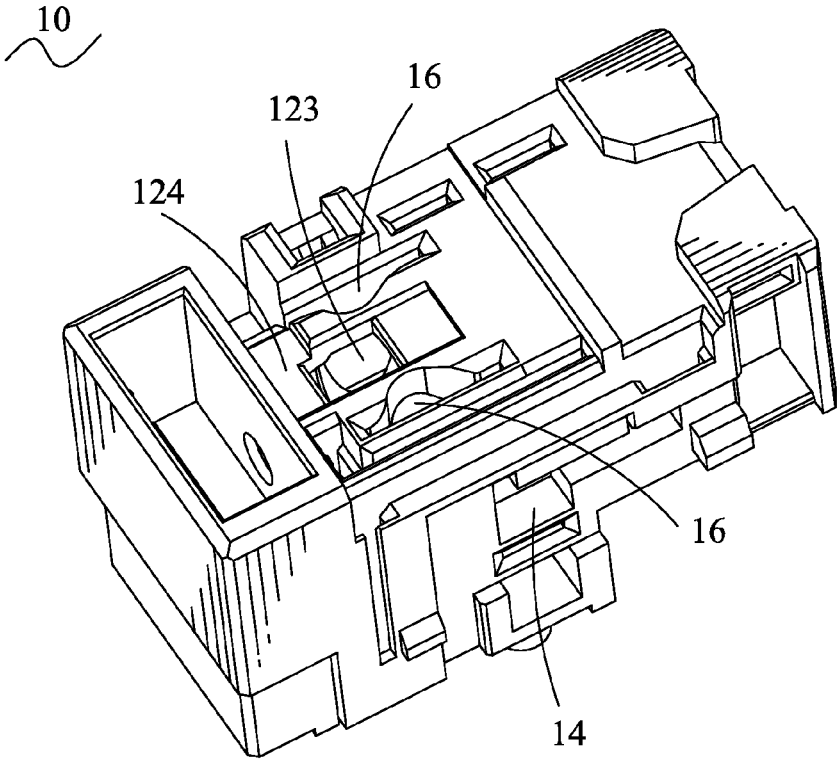

Referring to FIGS. 2 to 4, the dielectric housing 10 is of rectangular parallelepiped shape and defines an insertion hole 11 extended along a front and rear direction for receiving an audio plug 200 (shown as FIG. 6) from a front thereof. A top surface of the dielectric housing 10 is cut off at a middle portion to form a fillister 12 lower than two ends of the dielectric housing 10. A containing chamber 15 is defined at a rear end of the dielectric housing 10 for receiving the LED 61 therein with the LED cover 62 covered thereon. The dielectric housing 10 defines two grounding terminal grooves 14 respectively disposed at two opposite sides thereof and a signal terminal groove (not shown) disposed at a bottom thereof, for receiving the two grounding terminals 43 and the first signal terminal 42, correspondingly.

A projecting beam 13 is transversely provided in the fillister 12 to divide the fillister 12 into a front receiving trough 121 for receiving the microphone terminal 41 and a rear receiving trough 122 for receiving the second signal terminal 44. A pair of retention channels 16 is longitudinally defined in a bottom of the rear receiving trough 122 and separated from each other for receiving the pair of retention pieces 50 which have arch portions 51 arched into the insertion hole 11 for gripping the audio plug 200 therebetween.

An opening 123 is defined at a middle of the bottom of the rear receiving trough 122 and located between the two retention channels 16. A substantial inverted-L shaped notch 124 is defined at a rear of the bottom of the rear receiving trough 122 and includes a level branch **124*a* communicated with a rear end of the opening 123 by an inner end thereof and a vertical branch 124*b* penetrating through a side of the dielectric housing 10. A location slot 125 is defined at the side of the dielectric housing 10 to intersect the vertical branch 124***b* of the notch 124. The dielectric housing 10 further defines a fixing hole 126 and an L-shaped receiving groove 127 separately positioned at two opposite sides of the rear receiving trough 122. In this embodiment, the fixing hole 126 is arranged at the same side of the location slot 125 and adjacent to a front end of one retention channel 16. The L-shaped receiving groove 127 is arranged opposite to the fixing hole 126, including a long groove 128 longitudinally extended behind the projecting beam 13 and a short groove 129 transversely extended towards the notch 124 from a rear end of the long groove 181 to fence the other retention channel 16.

The second signal terminal 44 has a base plate 441 whose opposite ends extended downwardly to form two fixed plates 442. An elastic arm 445 is extended rearward from a middle of a rear edge of the base plate 441 with a concaved portion 446 formed at a rear end thereof and a cantilever arm 447 transversely connected to a rear of the concaved portion 446. A free end of the cantilever arm 447 is inclined downward to form a pressing portion 448. An elongated connecting strip 443 is extended rearward from an upper portion of a rear edge of one fixed plate 442. A rear end of the connecting strip 443 is bent towards the cantilever arm 447 and then extended downwardly to form an upright soldered pin 444.

The detection terminal 45 is shaped as a strip, having a fixed base 452 at a middle thereof, an inclined portion 451 inclined sideward from a top of the fixed base 452 and an upright soldered pin 453 extended downwardly from a bottom of the fixed base 452. A protuberance 454 is provided on an outer surface of the inclined portion 451. In this embodiment, the pressing portion 448 of the second signal terminal 44 and the inclined portion 451 of the detection terminal 45 are inclined at an inclination angle of approximately 45 degrees from the cantilever arm 447 and the fixed base 452, respectively.

In assembly, the detection terminal 45 is inserted into the location slot 125 with the soldered pin 453 exceeded a bottom of the dielectric housing 10 and the inclined portion 451 located in the vertical branch 124*b* of the notch 124. The second signal terminal 44 is disposed in the rear receiving trough 122 with the two fixed plates 442 respectively inserted into the fixing hole 126 and a front end of the long groove 128. The connecting strip 443 is received in the long groove 128. The soldered pin 444 is inserted into the short groove 129 and exceeded the bottom of the dielectric housing 10. The concaved portion 446 is projected into the insertion hole 11 from the opening 123. The cantilever arm 447 is located to the level branch 124*a* of the notch 124 with the pressing portion 448 pressing against the protuberance 454 of the inclined portion 451. The shielding shell 20 encircles the dielectric housing 10 and the insulating cap 30 is assembled at front of the dielectric housing 10.

Figure 5:
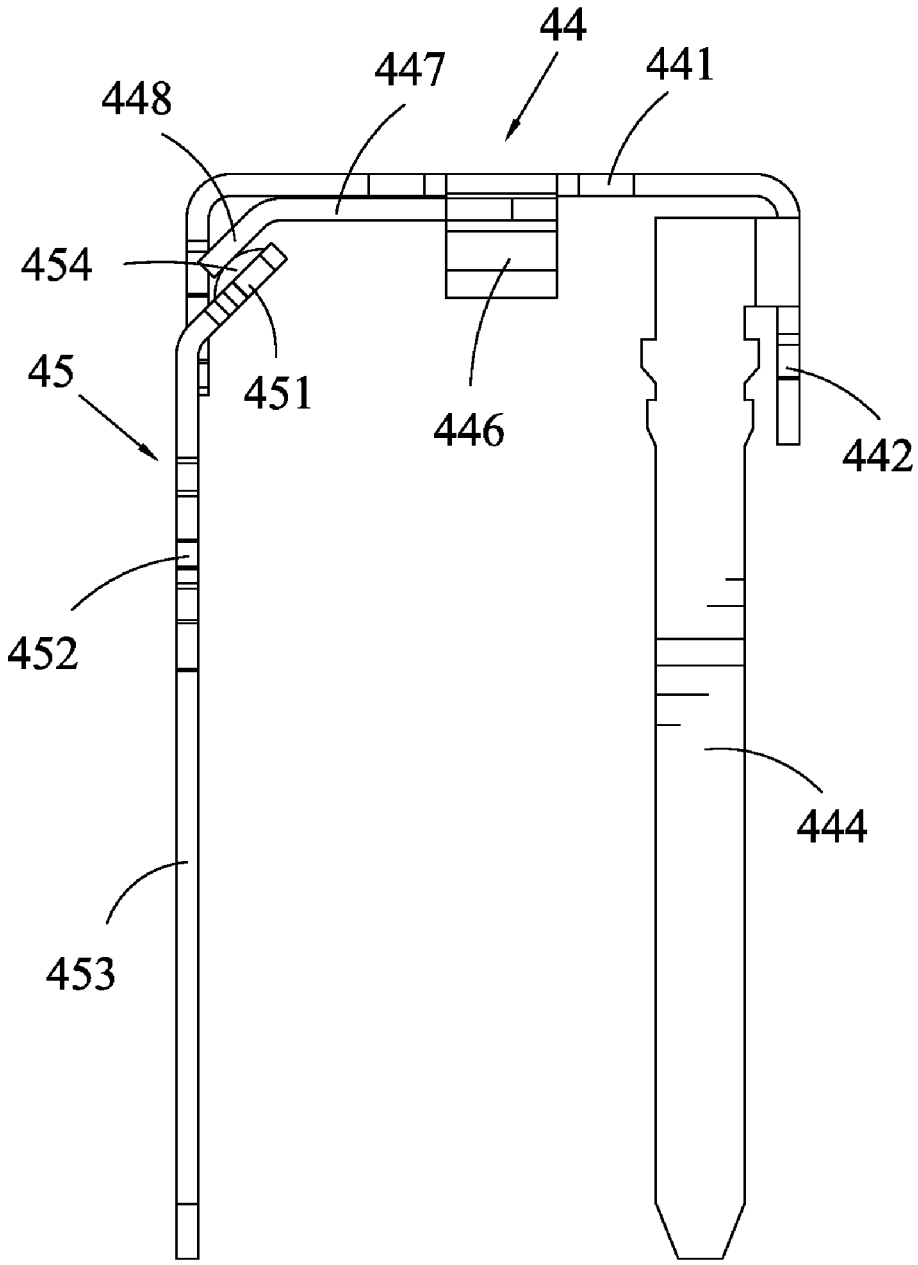
FIG. 5 shows a relationship between a signal terminal and a detection terminal before an audio plug is inserted thereinto.
Figure 6:
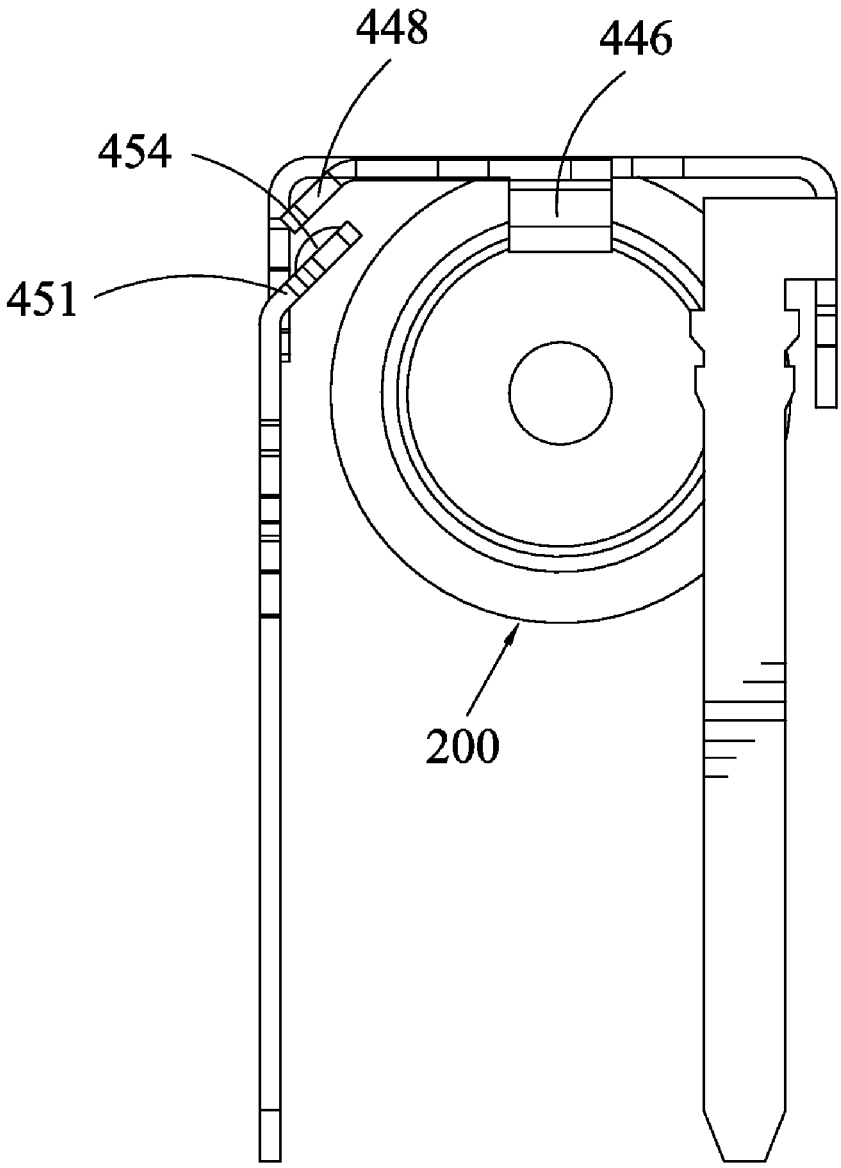
FIG. 6 shows a relationship between the signal terminal and the detection terminal when an audio plug has been inserted thereinto.

With reference to FIGS. 5 and 6, before the audio plug 200 is inserted into the audio jack connector 100, the pressing portion 448 of the second signal terminal 44 elastically presses against the protuberance 454 of the detection terminal 45. When the audio plug 200 is inserted into the insertion hole 11, the audio plug 200 pushes up the concaved portion 446 to drive the pressing portion 448 moved up at the same time. Then the pressing portion 448 and the protuberance 454 are detached from each other. After the audio plug 200 is drawn out from the insertion hole 11, the elastic arm 445 moves down because of its elasticity to make the pressing portion 448 press down the protuberance 454. During the pressing process, the pressing portion 448 rubs against the protuberance 454 simultaneously to remove the external objects like dust, greasiness and oxide formed therebetween. Therefore, the electrical connection between the pressing portion 448 and the protuberance 454 is stable.

As described above, because of the inclination arrangement of the pressing portion 448 and the inclined portion 451, during pressing down the protuberance 454, the pressing portion 448 rubs against protuberance 454 at the same time to remove the external objects formed therebetween. And therefore, the electrical connection between the pressing portion 448 and the protuberance 454 is stable, which helps to currently detect whether the audio plug 200 is inserted or not.

What is claimed is:

1. An audio jack connector for receiving an audio plug, comprising:

a dielectric housing, the dielectric housing defining an insertion hole extended along a front and rear direction for receiving the audio plug from a front thereof and a receiving trough at a rear portion of a top surface thereof, an opening being defined at a middle of the receiving trough, a notch being communicated with a rear end of the opening and transversely penetrating through a side of the dielectric housing, a location slot being defined at the side of the dielectric housing to intersect the notch;

a detection terminal having a fixed base inserted into the location slot and an inclined portion inclined towards the notch from a top of the fixed base, the inclined portion having a protuberance provided on an outer surface thereof; and a signal terminal received in the receiving trough, the signal terminal having a base plate and an elastic arm extended rearward from a middle of a rear edge of the base plate, the elastic arm having a concaved portion formed at a rear end thereof to project into the insertion hole from the opening and a cantilever arm transversely connected to a rear of the concaved portion by an inner end thereof to be located to the notch, a free end of the cantilever arm being inclined downward to form a pressing portion for pressing against or detaching from the protuberance of the detection terminal when the audio plug is drawn out or inserted into the insertion hole of the dielectric housing;

wherein two opposite sides of the receiving trough respectively define a fixing hole at the same side of the location slot and an L-shaped groove opposite to the fixing hole, the L-shaped groove includes a long groove longitudinally extended and a short groove transversely extended towards the notch from a rear end of the long groove.

2. The audio jack connector as claimed in claim 1, wherein two opposite ends of the base plate of the signal terminal bend downwardly to form two fixed plates respectively inserted into the fixing hole and a front end of the long groove.

3. The audio jack connector as claimed in claim 2, wherein an upper portion of a rear edge of one fixed plate extends rearward to form an elongated connecting strip received in the long groove, a rear end of the connecting strip transversely bends towards the cantilever arm and then extends downwardly to form an upright soldered pin inserted into the short groove with a bottom end thereof exceeded a bottom of the dielectric housing.

4. The audio jack connector as claimed in claim 1, wherein the detection terminal has an upright soldered pin extended downwardly from a bottom of the fixed base and exceeded a bottom of the dielectric housing.

5. The audio jack connector as claimed in claim 1, wherein the pressing portion of the signal terminal and the inclined portion of the detection terminal are inclined at an inclination angle of approximately 45 degrees from the cantilever arm and the fixed base, respectively.

6. The audio jack connector as claimed in claim 1, wherein the notch is substantially inverted-L shape and includes a level branch communicated with the rear end of the opening by an inner end thereof and a vertical branch penetrating through the side of the dielectric housing, the location slot intersects the vertical branch of the notch, the inclined portion of the detection terminal is located in the vertical branch of the notch, the cantilever arm of the signal terminal is located in the level branch of the notch.

* * * * *